US008585566B2

(12) United States Patent
Mackel et al.

(10) Patent No.: US 8,585,566 B2
(45) Date of Patent: Nov. 19, 2013

(54) SEPARATOR DRUM HAVING A DISTRIBUTOR FLOW CHANNEL WITH A DAM

(75) Inventors: Wilfried Mackel, Lippetal/Herzfeld (DE); Thomas Bathelt, Oelde (DE); Ludger Thiemann, Oelde (DE); Kathrin Quiter, Drensteinfurt (DE); Andreas Penkl, Lippetal (DE); Jürgen Linnemann, Beckum (DE); Thomas Kleimann, Oelde (DE); Jürgen Starke, Oelde (DE); Wilhelm Helling, Oelde (DE); Bärbel Helling, legal representative, Oelde (DE); Stephan Helling, legal representative, Oelde (DE); Tobias Helling, legal representative, Oelde (DE)

(73) Assignee: GEA Mechanical Equipment GmbH, Oelde (DE)

( * ) Notice: Subject to any disclaimer, the term of this patent is extended or adjusted under 35 U.S.C. 154(b) by 108 days.

(21) Appl. No.: 13/000,762

(22) PCT Filed: Jun. 25, 2008

(86) PCT No.: PCT/EP2008/005152

§ 371 (c)(1), (2), (4) Date: May 19, 2011

(87) PCT Pub. No.: WO2009/155943

PCT Pub. Date: Dec. 30, 2009

(65) Prior Publication Data

US 2011/0215044 A1 Sep. 8, 2011

(51) Int. Cl.
*B04B 11/06* (2006.01)

(52) U.S. Cl.
USPC ..... 494/70

(58) Field of Classification Search
USPC ..... 494/64, 67–73
See application file for complete search history.

(56) References Cited

U.S. PATENT DOCUMENTS

| | | | | | |
|---|---|---|---|---|---|
| 801,068 | A | * | 10/1905 | Fleming | 494/30 |
| 801,069 | A | * | 10/1905 | Fleming | 494/43 |
| 1,760,071 | A | * | 5/1930 | Koepke | 494/67 |
| 2,104,683 | A | * | 1/1938 | Van Rosen et al. | 55/403 |
| 2,243,697 | A | * | 5/1941 | Forsberg | 494/15 |
| 2,302,381 | A | * | 11/1942 | Seott | 494/65 |

(Continued)

FOREIGN PATENT DOCUMENTS

| | | |
|---|---|---|
| DE | 1 896 480 | 7/1964 |
| DE | 1 432 794 | 4/1969 |

(Continued)

*Primary Examiner* — Charles E Cooley
(74) *Attorney, Agent, or Firm* — Barnes & Thornburg LLP

(57) ABSTRACT

A rotatable separator drum includes a vertical rotating axis of rotation and at least one flow channel having an inlet opening and an outlet opening. Also included is at least one retaining dam arranged in the at least one flow channel in a region between the inlet opening and the outlet opening. The at least one retaining dam is configured to allow an overflow of liquid over the at least one dam and to provide for an accumulation of solids in front of the at least one dam. The at least one dam includes at least one rib arranged in a transitional region between opposing wall sections and a distributor base cover and the at least one rib includes portions having differing heights.

11 Claims, 3 Drawing Sheets

(56) References Cited

U.S. PATENT DOCUMENTS

| | | | | |
|---|---|---|---|---|
| 2,645,415 | A | 7/1953 | Strezynski | |
| 3,642,196 | A * | 2/1972 | Nilsson | 494/2 |
| 3,963,175 | A * | 6/1976 | Daubman et al. | 494/74 |
| 4,430,071 | A * | 2/1984 | Willus et al. | 494/38 |
| 4,482,344 | A * | 11/1984 | Zettier | 494/70 |
| 4,614,598 | A * | 9/1986 | Zettier et al. | 210/781 |
| 4,721,505 | A * | 1/1988 | Inge et al. | 494/74 |
| 5,362,292 | A * | 11/1994 | Borgstrom et al. | 494/74 |
| 6,102,843 | A * | 8/2000 | Kelley et al. | 494/29 |
| 7,306,556 | B2 * | 12/2007 | Pitkamaki et al. | 494/67 |
| 2007/0032363 | A1 * | 2/2007 | Pitkamaki et al. | 494/67 |
| 2011/0215044 | A1 * | 9/2011 | Mackel et al. | 210/403 |
| 2012/0108413 | A1 * | 5/2012 | Mackel | 494/65 |

FOREIGN PATENT DOCUMENTS

| | | | | |
|---|---|---|---|---|
| DE | 30 42 948 | | 7/1982 | |
| DE | 3713719 | C1 * | 4/1988 | B04B 11/06 |
| DE | 3805016 | A1 * | 11/1988 | |
| DE | 195 19 693 | | 8/1996 | |
| DE | 10 2006 047 478 | | 4/2007 | |
| DE | 102006047478 | A1 * | 4/2007 | |
| DE | 102007028102 | A1 * | 12/2008 | B04B 11/06 |

* cited by examiner

PRIOR ART

SEPARATOR DRUM HAVING A DISTRIBUTOR FLOW CHANNEL WITH A DAM

This application is a national stage of International Application PCT/EP2008/005152, filed Jun. 25, 2008, the content of which Application is incorporated by reference herein.

BACKGROUND OF THE INVENTION

The present relates to a rotatable separator drum with a vertical rotating axis. The separator drum includes at least one flow channel having an inlet opening and an outlet opening and may include a disk-shaped component located in at least one surface of the drum.

A generic separator drum is known, for example, from DE 19519693 C1 or DE 10 2006 047478 A1, with the disk-shaped component being the distributor base, which on its bottom side has a substantially conical shape and thus a respectively exemplary disk-like shape.

DE 18 96 480 U, DE 14 32 794 A, U.S. Pat. No. 2,645,415 A, DE 10 2006 047 478 A1 and DE 30 42 948 A1 are referenced with regard to the state of the art.

Distributors are used for guiding the product to be processed from a feed pipe through the flow channels, which are also known as distributor conduits, into the drum. This construction has proven its worth. It is problematic, however, that the flow channels are subjected to a higher amount of wear and tear, especially in processing products which contain abrasively acting solid matter. Such wear and tear can have a disadvantageous effect on the service life of the distributor. Similar problems can occur in other elements of the separator drum, especially the disk-shaped components, such as separator disks, drum parts or plates which are attached to the inside surfaces of the drum parts. For example, the flow progresses from the outside to the inside on the separator disks, whereas it progresses from the inside to the outside otherwise.

The present disclosure relates to solving this problem.

The present disclosure thus relates to a rotatable separator drum having a vertical axis of rotation and at least one flow channel having an inlet opening and an outlet opening. Further included is at least one retaining dam arranged in the at least one flow channel in a region between the inlet opening and the outlet opening. In front of which at least one retaining dam, an accumulation of solid matter forms during an operation of a processing of a solid-matter-containing product by the rotatable separator drum. A disk-shaped component may be located on at least one surface of the drum and at least one flow channel may be formed on the disk-shaped component.

Accordingly, at least one retaining dam is arranged in the at least one flow channel between the inlet opening and the outlet opening, wherein solid matter accumulates during operation in front of the retaining dam while the product containing solid matter is processed.

The component, which is disk-shaped in at least one surface, is a base section of a distributor which is connected with the drum in a torsion-proof manner. The base section is provided with at least one or several of the flow channels which extend at an angle in relation to the rotational axis, for example, radially to the outside. At least one of the retaining dams is arranged in the at least one flow channel in the region between the inlet opening and the outlet opening.

The retaining dam is arranged in such a way that solid matter will accumulate in front of the retaining dam in operation during the processing of a solid-containing product in the direction of flow from the inside to the outside. Such an accumulation or accumulations of material act, in the operation of the separator, like a wearing protection for the disk-shaped part, especially for the cover of the distributor base. The present disclosure relates to a separator drum that achieves this processing in a simple comprehensive way.

At least one embodiment, according to the present disclosure, is disclosed and described herein.

Other aspects of the present disclosure will become apparent from the following descriptions when considered in conjunction with the accompanying drawings.

DETAILED DESCRIPTION

Figure 1:
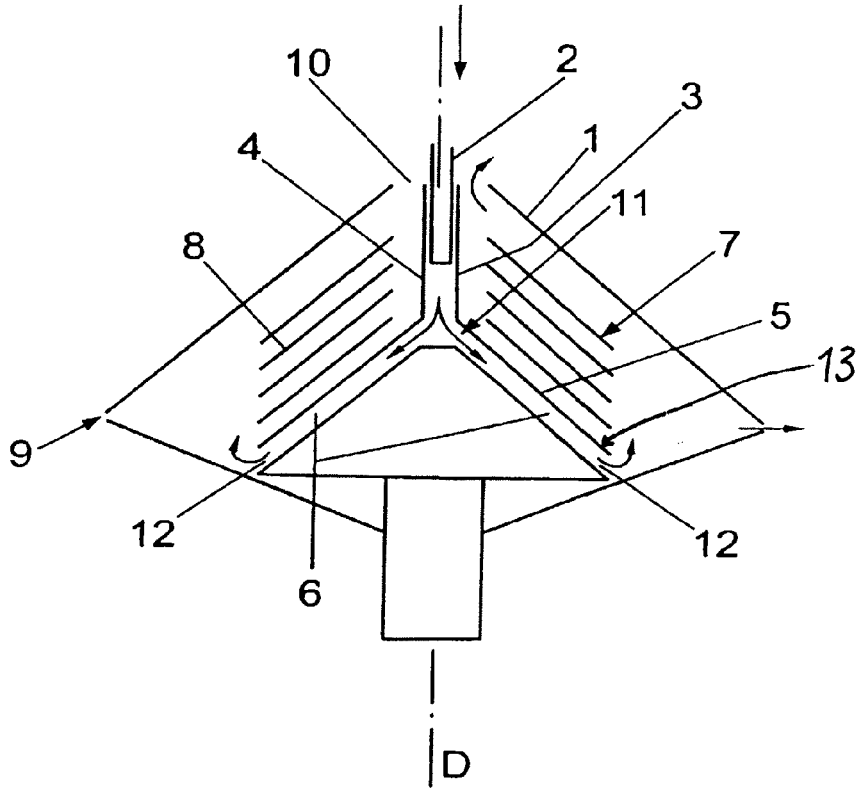
FIG. 1 shows a schematic view of a separator drum, according to the present disclosure.
Figure 2:
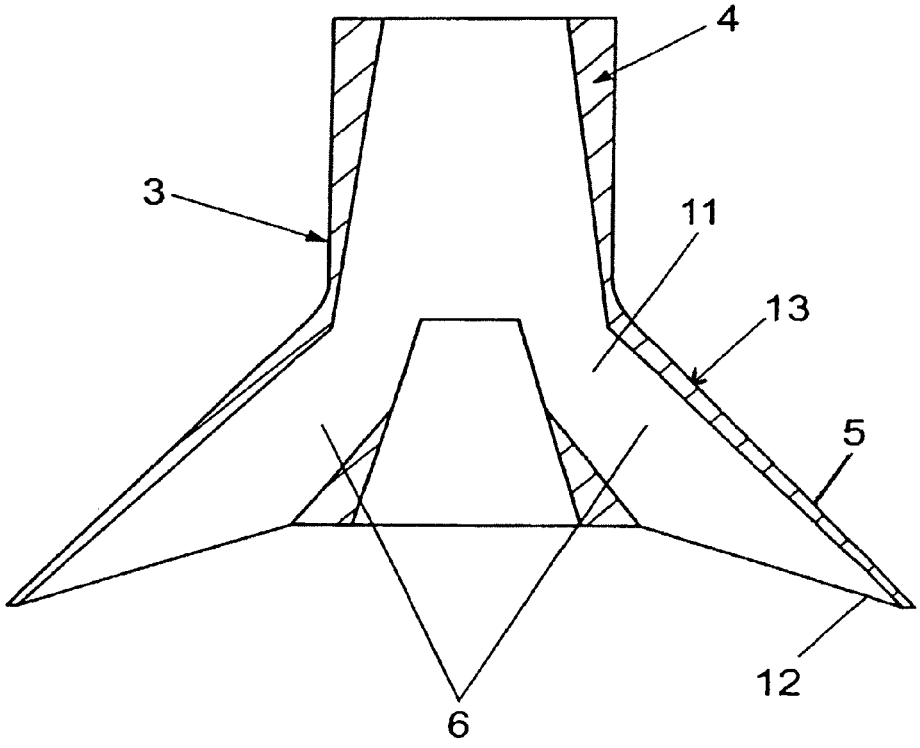
FIG. 2 shows a sectional view through a known distributor for a separator drum.

FIG. 1 shows a separator drum 1 with a vertical rotating axis D which comprises a centric feed pipe 2 which opens into a distributor 3. The distributor 3 comprises a centric inlet pipe section 4 at its entrance in axial extension of the feed pipe 2 which converges into a base section 5.

Radially outwardly extending flow channels 6 are adjacent to the centric inlet pipe section 4 in the base section 5 in a circumferentially distributed manner at an angle to the rotating axis D. Such an angle may, for example, be an acute or right angle. The flow channels 6 extend with respect to the rotating axis D in a downwardly oblique way, for example. The flow channels 6 may also be arranged at an acute angle from the inlet feed pipe section 4 in an upwardly oblique way.

A stack 7 of separator disks 8 is arranged in the drum 1. Discharges 9, 10, for at least one or several liquids and, for example, what may be one solid phase, are used for discharging the separated and/or clarified phases from drum 1. The distributor 4 is fastened, via suitable means, to the drum 1. The product flow is indicated by the flow arrows.

The flow channels 6 extend in the distributor base 5 from the inlet openings 11 into the flow channels 6 to the outlet openings 12 from the flow channels 6 into the interior space of the separator drum 1.

The flow channels 6 are covered upwardly by a conical distributor base cover 13. The flow channels 6 are delimited by wall sections 14 on a side or in a circumferential direction. The distributor base cover 13 is arranged in a disk-like manner on a bottom side of the flow channels 6.

Figure 3:
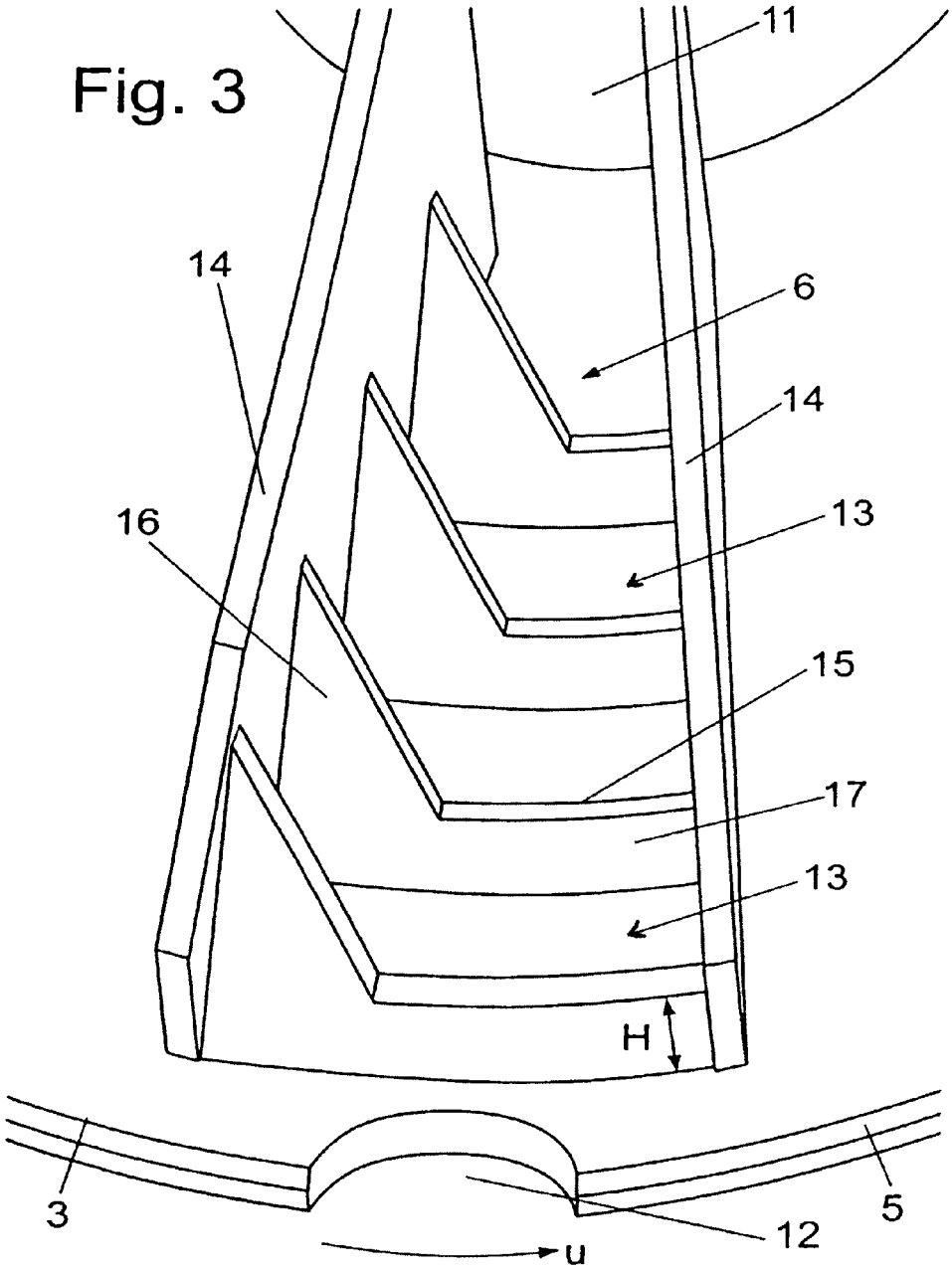
FIG. 3 shows a perspective view from below of a flow channel of a distributor, in accordance with the present disclosure.

Several retaining dams 15 are arranged in the flow channels 6 in a region between the inlet openings 11 and the outlet openings 12, as seen in FIG. 3. FIG. 3 illustrates a retaining dam 15 in the manner of a view beneath the distributor base cover 13. The retaining dams 15 constrict the cross section of the flow channel 6 in this region.

The retaining dams 15 may be arranged or comprised as ribs. These ribs 15 may be arranged or formed in the transitional region between one of the side walls or wall sections 14 and the distributor base cover 13. Thus may occur, for example, in the transitional region between the wall section 14, which is at the rear in operation in a direction of rotation U, and the distributor base cover 13. In the circumferential direction, the flow channels 6 are separated from one another by the wall sections 14.

According to the present disclosure, the ribs 15 may have a triangular section 16 in the region which extends on the bottom side of the distributor base cover 13 over a portion of the circumferential length of the flow channel 6 and then converges into a web section 17. The substantially triangular section 16 can also be arc-shaped, for example, in its region of its base side 18. A height H of the sections 15 and 16 may be at least 2 mm or more. The section 16, for example, may extend up to the side wall 14 which is the next one in the circumferential direction. According to the present disclosure, more than three dams 15 may be distributed in each flow channel 6. According to the present disclosure, a continuous wear-protecting coating may be formed over time on the bottom side of the distributor base cover 13.

In the direction of flow, which extends radially from the inside to the outside, accumulations of solid matter, or a layer of the solid matter, are formed in the direction of flow from the inside to the outside before the ribs 15, which accumulations are unproblematic in the processing of products that are not critical from a hygienic standpoint on the one hand, and which are advantageous as a wearing protection on the other hand, thus acting in a life-extending capacity.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A rotatable separator drum comprising:

a vertical axis of rotation;

at least one flow channel having an inlet opening and an outlet opening;

at least one retaining dam arranged in the at least one flow channel in a region between the inlet opening and the outlet opening;

the least one retaining dam is configured to allow an overflow of liquid over the at least one dam and is configured to provide for an accumulation of solid matter during an operation of a processing of a solid-matter-containing product by the rotatable separator drum; and the at least one dam includes at least one rib arranged in a transitional region between opposing wall sections and a distributor base cover and the at least one rib includes portions having differing heights.

2. The separator drum according to claim 1, wherein the at least one rib is arranged in the transitional region between the opposing wall sections, which, in operation, is at a rear when viewed in a rotational direction, and the distributor base cover covering the flow channel.

3. The separator drum according to claim 1, wherein the at least one rib is arranged on a bottom side of the distributor base cover.

4. The separator drum according to claim 1, wherein the at least one rib includes a triangular section which converges on a bottom side of the distributor base cover into a web section.

5. A rotatable separator drum comprising:

a vertical axis of rotation;

a disk-shaped component located on at least one surface of the drum and at least one flow channel is formed on the disk-shaped component, the at least one flow channel including an inlet opening and an outlet opening;

at least one retaining dam is arranged in the at least one flow channel in a region between the inlet opening and the outlet opening;

the least one retaining dam is configured to allow an overflow of liquid over the at least one dam and is configured to provide for, an accumulation of solid matter in front of the at least one dam during an operation of a processing of a solid-matter-containing product by the rotatable separator drum; and the at least one dam includes at least one rib arranged in a transitional region between opposing wall sections and a distributor base cover and the at least one rib includes portions having differing heights.

6. The rotatable separator drum according to claim 5, wherein the disk-shaped component includes a base section of a distributor, which disk-shaped component is connected with the drum in a torsion-proof manner, the base section being provided with the at least one flow channel which extends radially to the outside at an angle with respect to the rotating axis, and the least one retaining dam being arranged in the at least one flow channel in the region between the inlet opening and the outlet opening.

7. The rotatable separator drum according to claim 5, wherein the disk-shaped component is a separator disk which is attached to an inside surface of a drum part.

8. The separator drum according to claim 5, wherein the at least one retaining dam includes a plurality of retaining dams and a plurality of flow channels defined between the opposing wall sections with at least one of the retaining dams being arranged in at least one of the flow channels.

9. The separator drum according to claim 8, wherein the retaining dams each are arranged behind one another radially to the outside in the flow channels.

10. The separator drum according to claim 5, wherein the at least one rib is arranged in the transitional region between the opposing wall sections, which, in operation, is at a rear when viewed in a rotational direction, and the distributor base cover.

11. The separator drum according to claim 5, wherein the at least one rib includes a triangular section which converges on a bottom side of the distributor base cover into a web section.

* * * * *